US005472597A

United States Patent [19]

Carro

[11] Patent Number: 5,472,597

[45] Date of Patent: Dec. 5, 1995

[54] CONTROLLED FLOATING ASPIRATORS SYSTEM

[76] Inventor: Francisco J. J. Carro, Castilla 14-1 C, E-39002 Santander, Spain

[21] Appl. No.: 193,116

[22] PCT Filed: Jun. 8, 1993

[86] PCT No.: PCT/ES93/00049

§ 371 Date: Jul. 20, 1994

§ 102(e) Date: Jul. 20, 1994

[87] PCT Pub. No.: WO93/25435

PCT Pub. Date: Dec. 23, 1993

[30] Foreign Application Priority Data

Jun. 9, 1992 [ES] Spain ..... 9201197
May 20, 1993 [ES] Spain ..... 9301083

[51] Int. Cl.[6] ..... E02B 15/04
[52] U.S. Cl. ..... 210/122; 210/242.3; 210/923
[58] Field of Search ..... 210/122, 242.3, 210/923, 776

[56] References Cited

U.S. PATENT DOCUMENTS

| | | | |
|---|---|---|---|
| 3,701,430 | 10/1972 | Tuttle | 210/242.3 |
| 3,753,497 | 8/1973 | Hoffman | 210/242.3 |
| 3,983,034 | 9/1976 | Wilson | 210/923 |
| 4,100,072 | 7/1978 | Uchida et al. | 210/923 |
| 4,182,679 | 1/1980 | Van Hekle | 210/242.3 |
| 5,118,413 | 6/1992 | Hagenes | 210/122 |

FOREIGN PATENT DOCUMENTS

| | | |
|---|---|---|
| 017168 | 10/1980 | European Pat. Off. . |
| 1532611 | 7/1968 | France . |
| 2483878 | 12/1981 | France . |
| 8302351 | 2/1985 | Netherlands . |

*Primary Examiner*—Christopher Upton
*Attorney, Agent, or Firm*—Helfgott & Karas

[57] ABSTRACT

A controlled floating aspirators system includes floating cages made of latticework and provided on their sides with floats to establish a working level suitable for the cage as a whole. Each cage has two frameworks at the sides thereof. The inner framework has a rolling skid through which the cage can move up and down along a respective slide provided on the ship. Within each cage are provided a front mouth and a rear exit. At least one floating aspirator module is provided on each cage, having floats which allow the cage to float on its own. The module has an aspiration nozzle coupled with a respective pump. The system may include an auxiliary aspirator module located in front of the module formed by the floating aspirator. Its purpose is to make up a floating support for the tailpieces of the floating barriers that are hauled by two tugs and direct the floating liquid to be collected, which flows through the auxiliary aspirator module, and is driven directly and in its entirety towards the module making up the floating aspirator module.

3 Claims, 3 Drawing Sheets

CONTROLLED FLOATING ASPIRATORS SYSTEM

BACKGROUND OF THE INVENTION

The present invention relates to a system of controlled floating aspirators to collect lower density liquids floating on another liquid, generally water.

The European Pat. EP-0024187 describes a system of controlled floating aspirators which mainly concentrates on collecting oil products floating on the surface of the sea, due to spillage from underwater oilfields, by collisions between tankers, groundings or any other cause or circumstance whatsoever giving rise to the so-called "oil spills".

More specifically, the system of the above-mentioned patent is based on fitting the sides of a tanker with V-shaped cages having a height so that when the ship is in ballast or empty the lower part of the cages will be submerged in the sea and, at the same time, the upper part of the cages will rise above the deep water-line of the ship. Inside each cage there is a number of floating aspirators capable of moving freely within the cages, adjusting to the slightest fluctuating movements of the liquid surface, so that the aspirators will remain floating on the sea at all times, regardless of the status of the ship on the water.

This solution, albeit perfectly acceptable as regards the results obtained from the standpoint of aspirating waste on the surface of the sea is, however, troublesome essentially in two respects.

On the one hand, the cages are huge in size and are hence very awkward to position, pose storage problems when not in use and must also undergo a heavy strain when inside the water, given their great length, which makes them difficult to use.

On the other hand, and since the characteristics of each ship are substantially variable, especially as regards their distance between the deep water-line and the water-line with the ship in ballast, a particular and specific cage is required for each type of ship, as regards the height of the cage, which makes it even more complicated to manufacture the cages and raises their cost.

SUMMARY OF THE INVENTION

It is an object of the present invention to fully solve the aforesaid problems in every respect, allowing a cage of small size to be used, which is easy to store and handle, and which cage can further be used in any other kind of ship, irrespective of the characteristics of the ship absolutely, as regards ballast and deep water-lines.

More specifically and in order to achieve the above object a floating cage of small size is provided, which can be moved into a container, to which end the cage as such is fitted with two large floats arranged on its sides in order not to stand in the way when products floating on the liquid surface enter the cage, the said cage being also provided on one of its sides, to be precise the side coupled to the ship, with a structure ending in skids through which the cage may move as a whole up and down slides operatively fixed to the outer side of the ship.

Each of the skids will be preferably fitted with two pairs of wheels with axes at right angles to each other in order for the wheels to act on either the side walls or on the bottom of the furrowed sections making up the said slides.

In accordance with another embodiment of the invention the structure of the floating cage is articulated to the above skids in order for the articulated joint to allow the skids to be at all times in the best position as regards the path followed by the slides, thereby to avoid their tendency to be blocked by the undulations on the surface of the water.

The floating cage structure thus provided with front deflectors to enhance its efficiency concentrating the products floating on the liquid surface towards the mouth of the cage as such, is fitted inside with one or more aspirating modules, which may be positioned on the upper part of the floating cage or else on the deck of the ship, which aspirator module can float full freely within the cage but will preferably be articulately linked to its front area in order to absorb the ship's pitching movements.

Another embodiment consists in including an auxiliary or complementary device positioned in front of the aforesaid aspirator module, the auxiliary device being comprised by a like module which is only distinct in that it has no aspiration system. This module or auxiliary device articulately positioned on the respective sides of the ship provides a floating support for the tails of the relevant barriers, which also float and are pulled by two tugs, defining the means to direct the floating liquid to be collected towards the respective controlled floating aspiration modules.

In this way both floating elements, viz. the auxiliary device comprised by the floating support for the collateral barrier tailpieces and the controlled floating aspirator, being similar elements as to their inner structure and being fixed in like fashion to the sides of the ship, will continually float in the same conditions which means that the floating liquid to be collected will be wholly driven to the aspirator, irrespective of the condition of the sea and the movements which the floating elements and the ship itself undergo during navigation.

The module comprising the controlled floating aspirator can include a sensor or detector to continually control the proportion of water being drawn in with the floating liquid to be collected, in order for the indications or warnings given by the sensor or detector to automatically cause the position of the aspiration mouth to be changed in order to prevent water from entering and thus achieve a fully efficient aspiration or removal of the spilt floating liquid.

BRIEF DESCRIPTION OF THE DRAWINGS

In order to provide a fuller description and contribute to the complete understanding of the characteristics of this invention, a set of drawings is attached to the specification which, while purely illustrative and not fully comprehensive, shows the following.

DESCRIPTION OF THE PREFERRED EMBODIMENTS OF THE INVENTION

Figure 1:
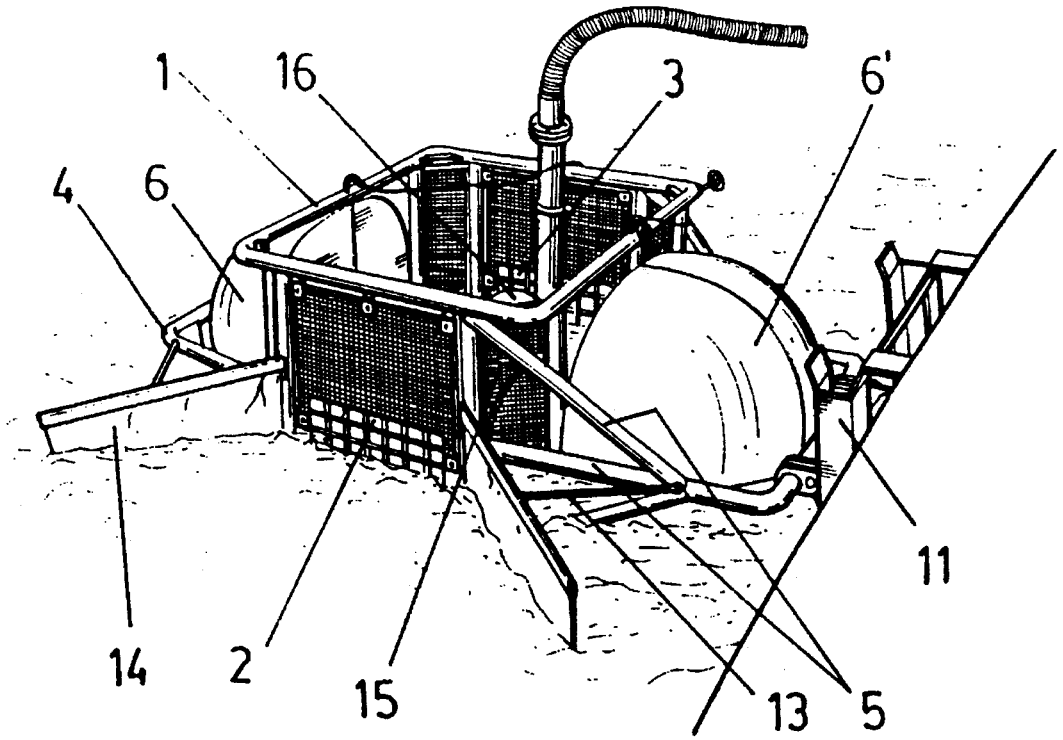
FIG. 1 is a perspective overview of a cage made in accordance with the improvements subject of the present invention, shown duly coupled to the ship hauling the same.
Figure 2:
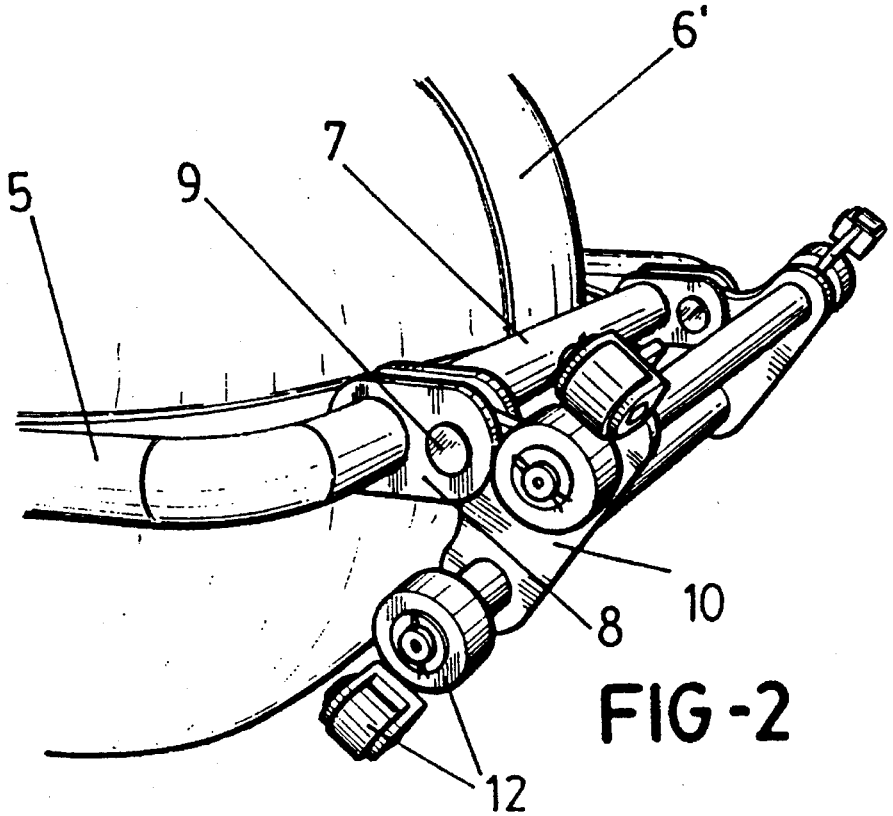
FIG. 2 is an enlarged close view of the same cage, at the height of the skid sliding up and down the side slides of the ship.

In light of these figures it is clear that in a system of controlled floating aspirators made in accordance with the invention the cage used in the system floats and has a suitably rigid structure (1) in which a duly latticed front mouth (2) and a rear and like exit (3) are defined, this structure (1) having side frameworks (4) and (5) supporting respective floats (6–6') that actually make it a floating cage, and of which the inner framework (5) is provided on its crossbar (7) furthest to the side with two pairs of lugs (8) to which a skid (10) is joined through bolts (9) designed to expedite the displacement of the cage as a whole up and down the respective side of the ship, in particular through slides (11) operatively established on the latter.

More specifically, the slides (11) comprise a pair of U-shaped furrowed sections with their inward bends facing each other, whereas the skid (10) is fitted at each end with two pairs of wheels (12), with axles at right angles to each other within each pair, in order for the wheels to ensure an optimal displacement of the skid, with a minimum friction factor both when the latter tends to rest on the bottom and on the side walls of the slides (11), the skid (10) taking up at all times the best position in relation to the side of the ship, due to the articulated joint through the bolts (9) to the cage (1) as such.

The framework (1) of the cage is fixed with deflector blades (14) framing its front mouth (2) in a markedly divergent position and duly stiffened by means of braces (13), which considerably increase the operating range or scope of the cage, this being clearly noted by merely looking at FIG. 1.

Within the cage as such and as structured above there is at least an aspirator module (15) which also floats and is to this end provided with a set of buoys (16), their number preferably being three, supporting an aspiration nozzle (17) associated to the respective pump that is not shown in the drawings, through the likewise respective conduit (18), which pump may as in the practical embodiment shown in the figures be positioned on the deck of the ship, but could just as well be located on the upper area of the cage (1) itself.

Figure 3:
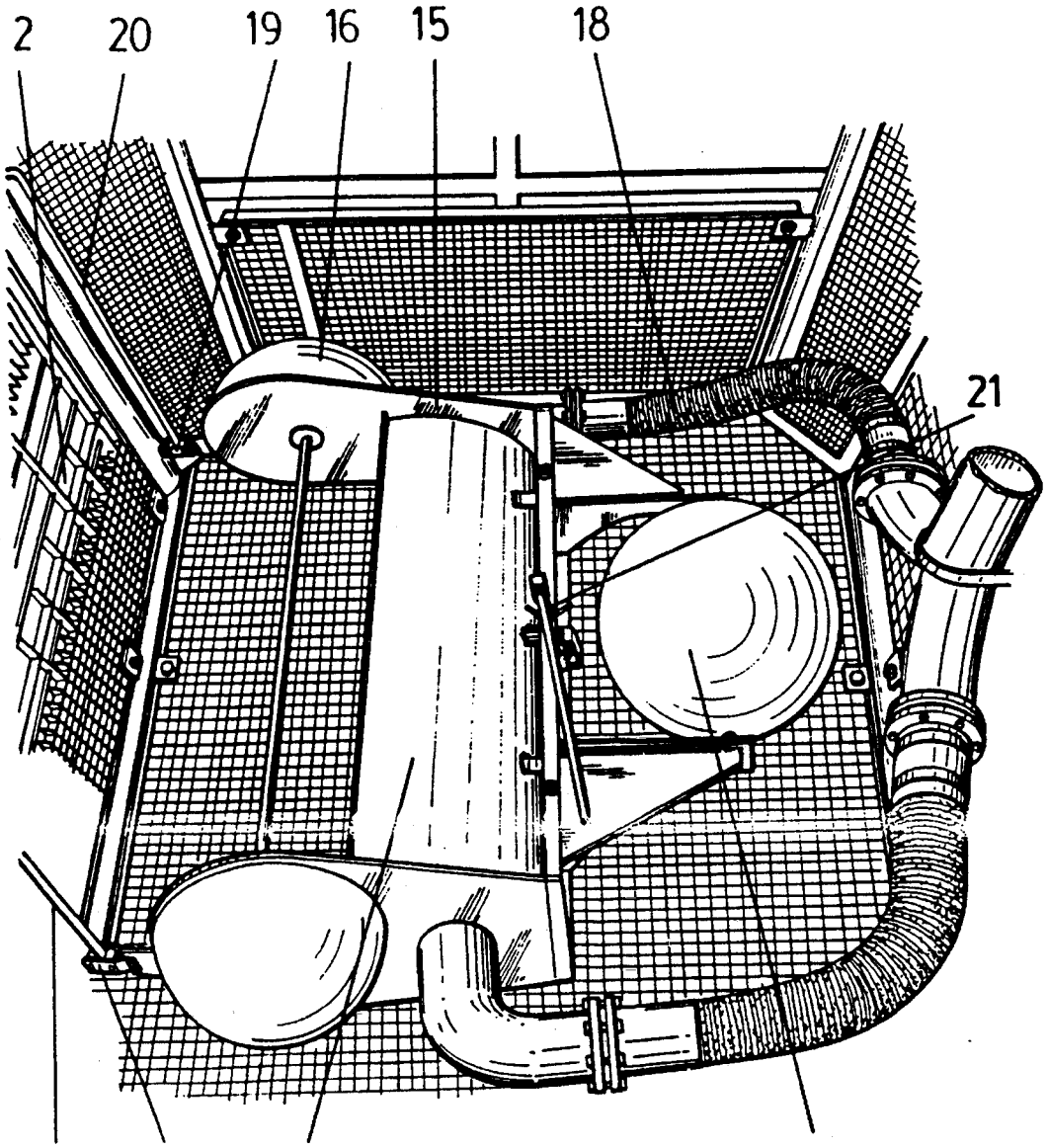
FIG. 3 is an inner perspective of the same cage, partially showing the aspirator module established therein.
Figure 4:
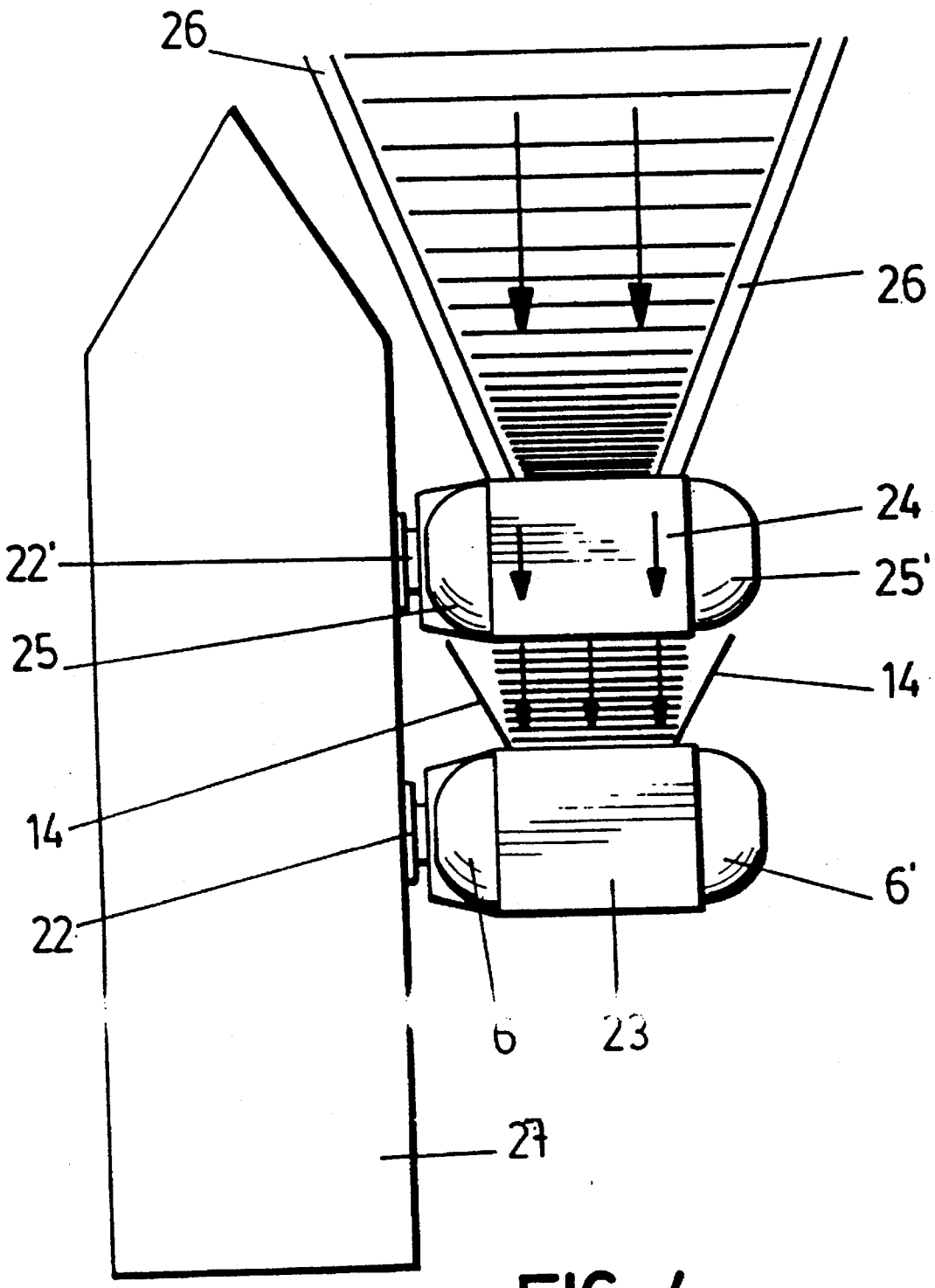
FIG. 4 is a top plan diagrammatic view of what can be considered a ship with one of its sides provided with a controlled floating aspirator module with its respective floats, likewise shown diagrammatically, and the auxiliary device making up the floating support, likewise making up a module of outer characteristics like the aforesaid module, fixed to the respective side of the ship in like wise.

This aspirator module (15) can be full independently established inside the cage (1) as such, or be duly fixed to the same as shown in FIG. 3, in particular by means of attachments with slide sheaves (19) located on its front vertices, outside its likewise front window (2), thereby for the aspirator module as a whole to be able to be at all times in the best position inside the cage (1), contemporaneously remaining at the most suitable level for the aspirator nozzle (17) to fulfil its function.

For its part the aspirator nozzle (17) is mounted on the floating frame (15) of the aspirator module through a spindle (21) that allows the nozzle (17) to be adjusted positionally in order in turn to regulate the "layer" of absorption on the water.

The system described can be complemented with an auxiliary or complementary device, shown in FIG. 3, in which it is clear that one of the sides of the relevant ship (27) is fitted with the above described means numbered (22) to articulate the respective module (23) defining the controlled floating aspirator, which module has been shown diagrammatically in this case and which relates to what is shown in FIGS. 1 and 3, with the respective floats (6) and (6') and moreover fitted with deflectors (14) as in the said figures.

Now then, as aforesaid, in a different embodiment or improvement, in addition to the module (23) on each side of the ship (27), a module (24) can be fitted with floats (25) and (25') and with means (22') linking to the side of the ship, so that the module (24) is exactly like the aforesaid module (23) as regards its outer structure and manner of being attached to the ship (27) but has no aspirator system as such, the module (24) making up a floating support to which the barriers (26) hauled by two tugs and directing the floating liquid that is to be collected towards the module (25) are fitted, the latter directing all the said floating liquid towards the module (23) making up the controlled floating aspirator.

Based upon the module (24), located in front of the aspiration module (23) and because they both behave in like manner, collection and driving of the floating liquid will be efficient irrespective of the condition of the sea and of the movements of the modules and the ship itself.

I claim:

1. A controlled floating aspirators system, comprising V-shaped floating cages coupled to sides of a ship, configured to be semi-submerged in the sea, and fitted with aspirators, each cage including a supporting structure of latticework, a front access mouth and a rear exit defined in said supporting structure, side frameworks, floats fixed to said frameworks to enable the cage to function as a floating cage, one of said frameworks being positioned on a side of the cage facing the ship and being provided with a rolling skid articulately positioned thereto by hinge bolts for sliding along vertical slides provided on the sides of the ship and being furrowed and U-shaped with inward bends thereof facing each other, said skid having two sides and having at each side two pairs of rollers mounted to turn freely on respective axles thereof at right angles to one another to provide a displacement of the skid on the slides so as to allow the floating cage to take up any position as regards height in relation to the ship, irrespective of the position of the water-line of the ship at any given time.

2. The controlled floating aspirators system according to claim 1; and further comprising at least one aspirator module positioned inside the floating cage and also floating, said aspirator module being fitted with a set of floats and having an aspiration mouth which is connected through a conduit to an aspiration pump, said aspirator module being connected to a front area of the cage by attachments sliding on vertical rods fixed to the supporting structure of the cage, at two sides of the mouth and leading into the mouth, so that said aspirator module is adjusted to a water level inside the cage irrespective of a degree of immersion thereof, said aspirator module having an aspiration nozzle fitted with a spindle allowing for adjustment of a level of penetration of the aspirator module in the water.

3. The controlled floating aspirators system according to claim 1; and further comprising at least two aspirator modules of identical structure and shape, one aspirator module being provided in front of another aspirator module, each aspirator module being fitted with means for linking to a side of the ship and with floats (25) and (25') similar to the floats fixed to said frameworks, one of said two aspirator modules being a complementary module forming a floating support for tailpieces of barriers for driving a floating liquid to be collected on another module, through which the liquid is directed in its entirety towards said another module making up a controlled floating aspirator.

* * * * *